US005203618A

United States Patent [19]

Oshall

[11] Patent Number: 5,203,618

[45] Date of Patent: Apr. 20, 1993

[54] RECYCLING ORGANIZER APPARATUS

[76] Inventor: William H. Oshall, R.D. 1, Box 51, Fallentimber, Pa. 16639

[21] Appl. No.: 719,611

[22] Filed: Jun. 24, 1991

[51] Int. Cl.[5] ..... A47B 81/00

[52] U.S. Cl. ..... 312/290; 312/22; 312/30; 220/404; 220/524; 220/909; 239/274

[58] Field of Search ..... 312/22, 30, 290; 220/404, 524, 553, 558, 909; 239/274, 289

[56] References Cited

U.S. PATENT DOCUMENTS

| | | | |
|---|---|---|---|
| 215,165 | 5/1879 | Romine | 312/290 X |
| 1,543,980 | 6/1925 | Blood | 312/290 |
| 2,044,559 | 6/1936 | Balster | 312/22 X |
| 2,510,357 | 6/1950 | Wilson | 312/22 |
| 3,100,066 | 8/1963 | Campbell | 239/274 X |
| 3,636,862 | 1/1972 | Bottas et al. | 239/274 X |
| 5,085,342 | 2/1992 | Strawder | 220/404 |

*Primary Examiner*—Kenneth J. Dorner

*Assistant Examiner*—Brian K. Green

*Attorney, Agent, or Firm*—Leon Gilden

[57] ABSTRACT

A housing includes spaced side walls and a top wall, with a front wall thereof defining a plurality of pivotally mounted doors providing access interiorly of the housing. An upper door plate is pivotally mounted above the door and between a forward edge of the top walls and the doors to provide access to a top wall pivoting plate mounting a can crusher and can opener to permit processing of various cans and their deposit within one of a plurality of pivoting door plates mounted rearwardly and hingedly within a top wall. Underlying replaceable bag members are mounted to receive the processed cans and other recycled material. A modification of the structure includes an aerosol apparatus automatically actuated upon downward projection of a pivoting door of the rows of pivoting doors positioned above the bags.

7 Claims, 5 Drawing Sheets

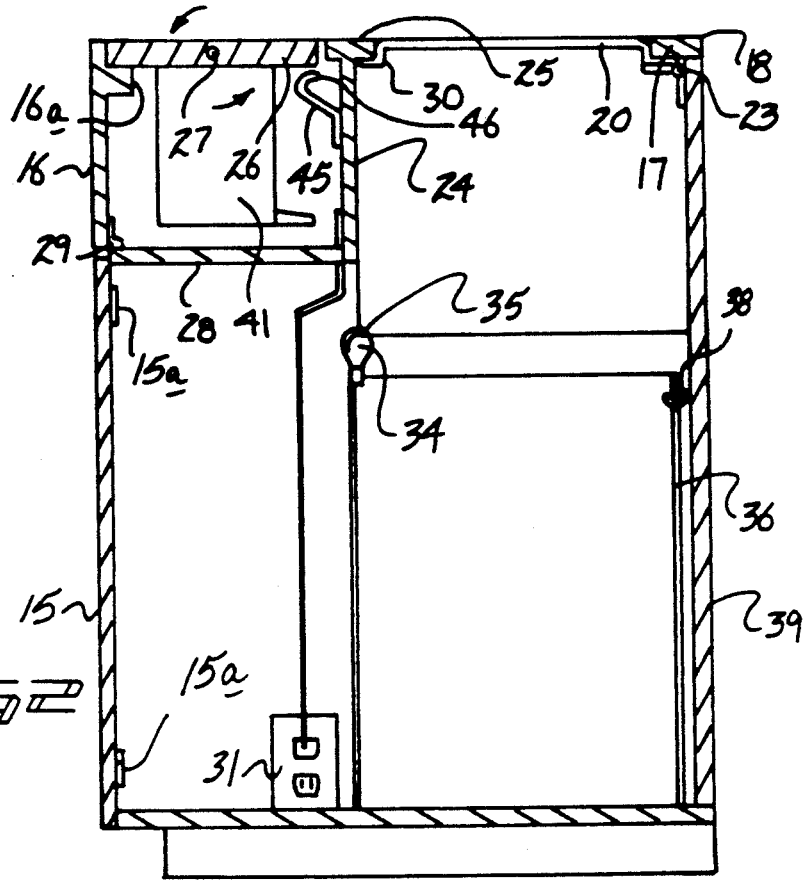
Fig 2
Fig 9
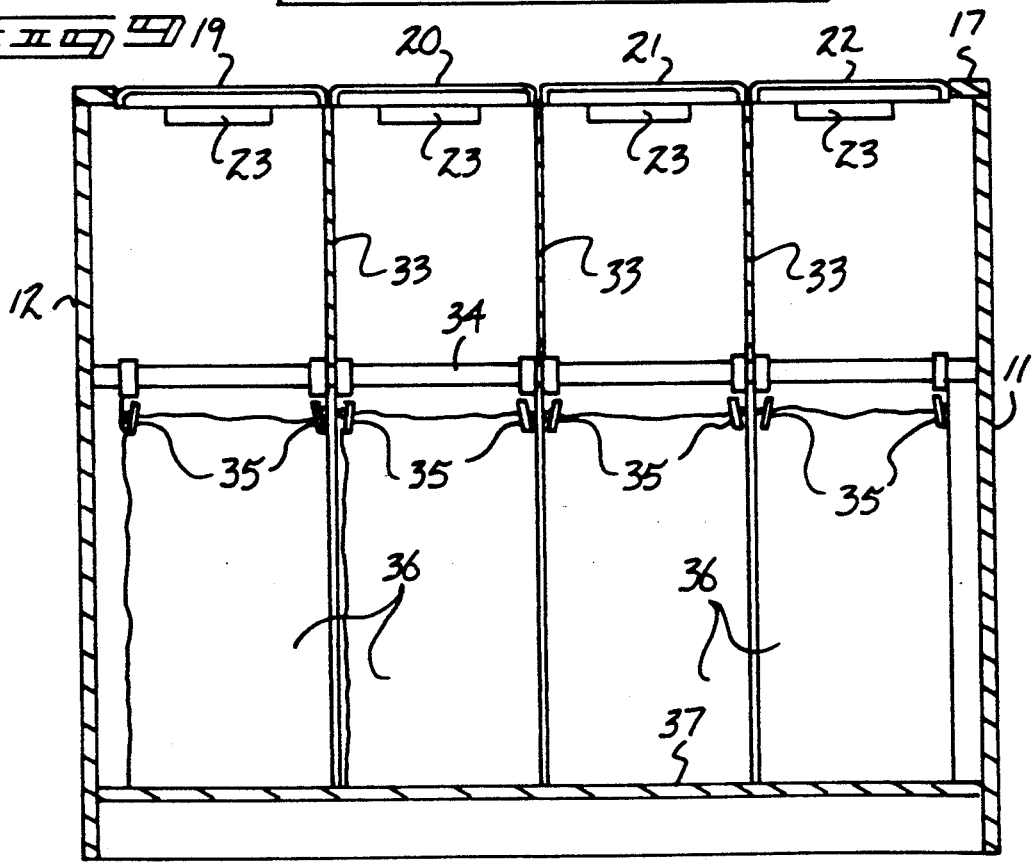

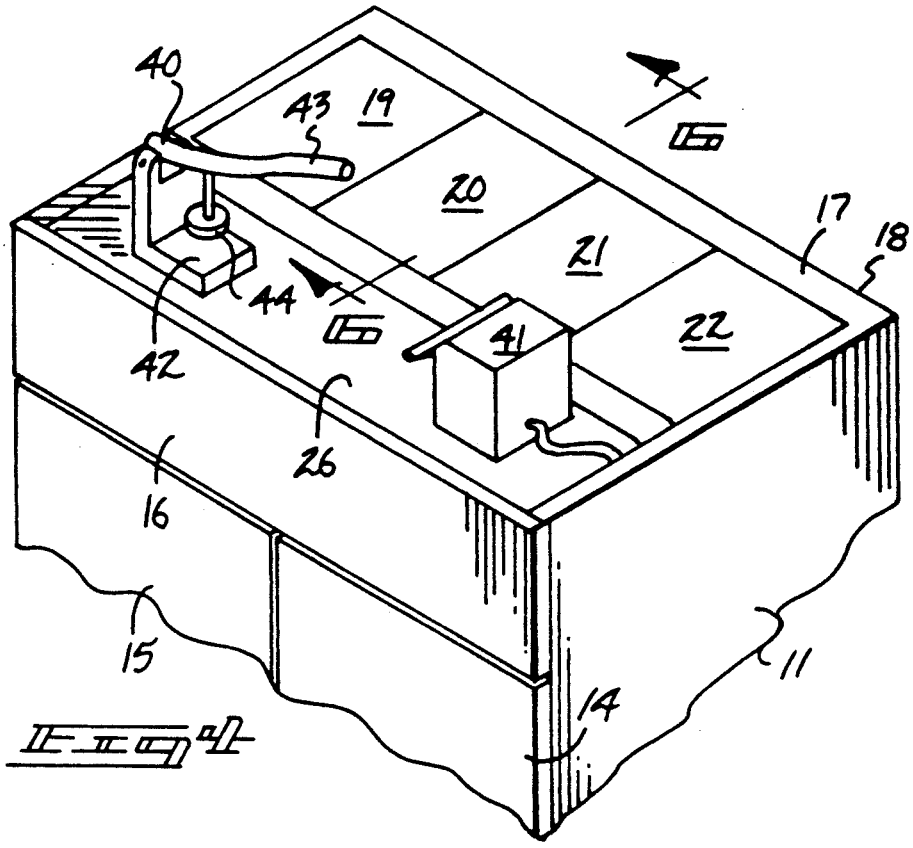
FIG. 4
FIG. 3
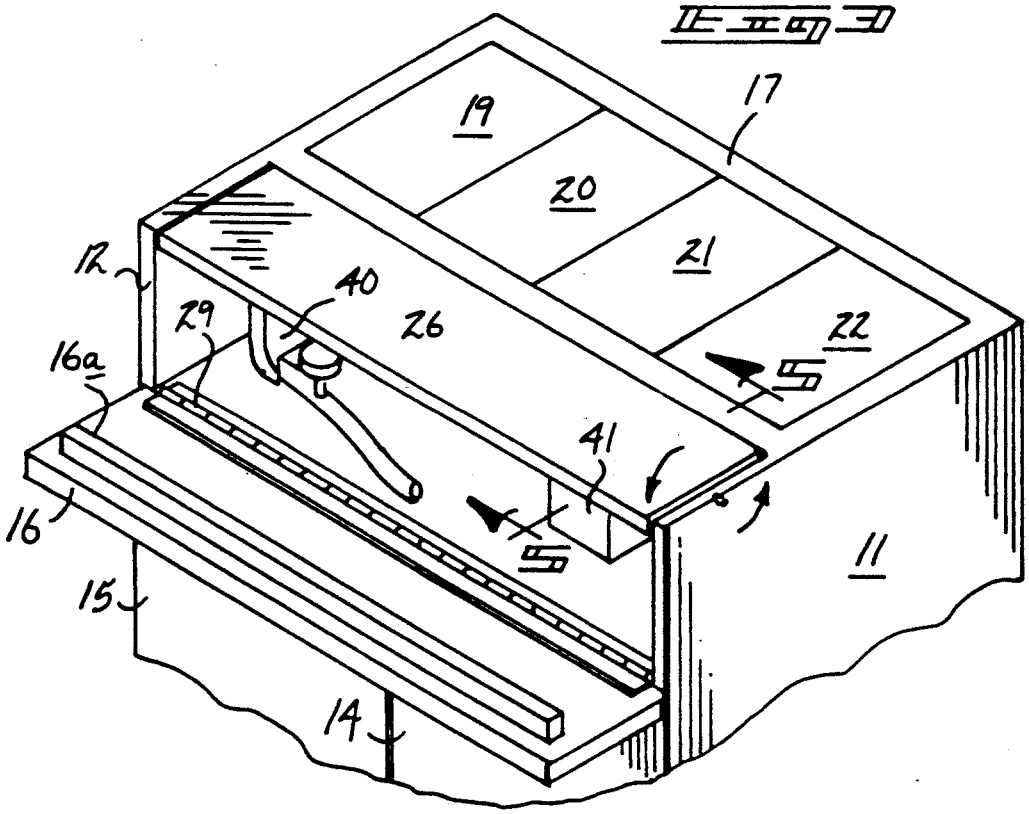

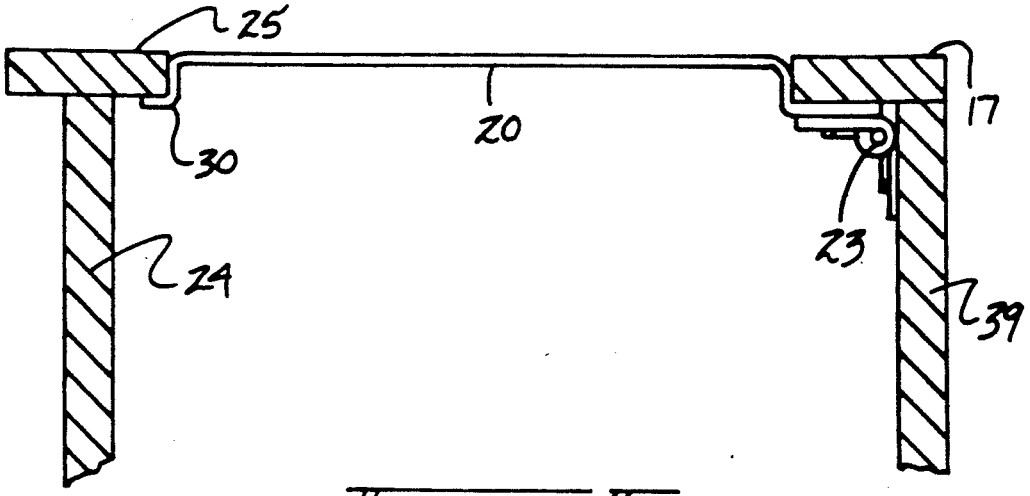
Fig 6
Fig 5
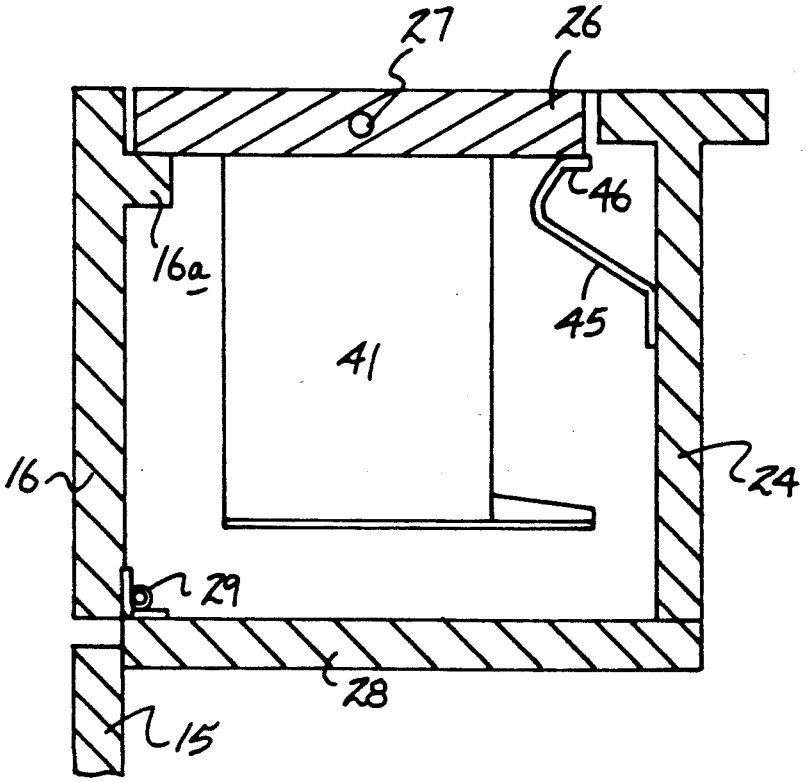

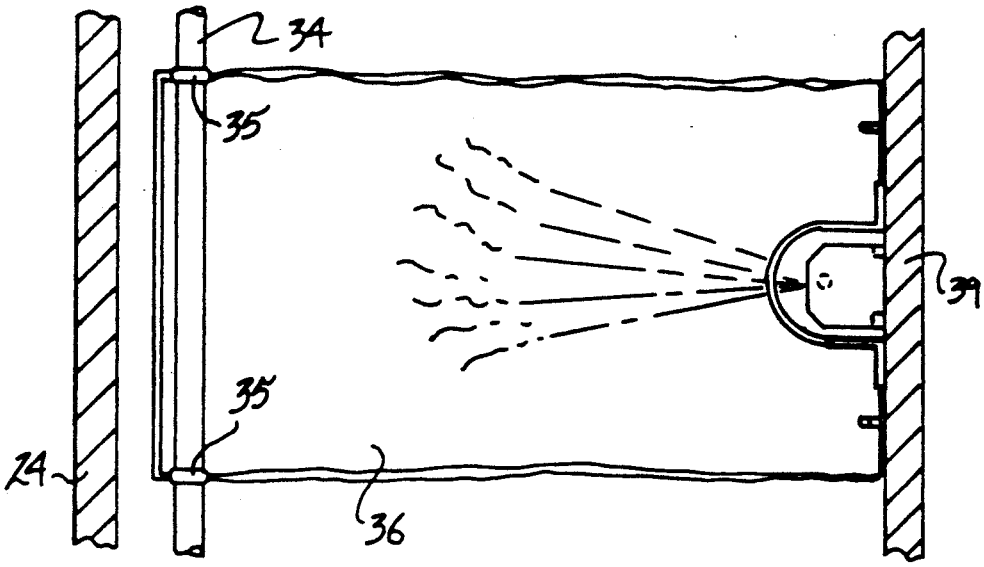
FIG 8B
FIG 7
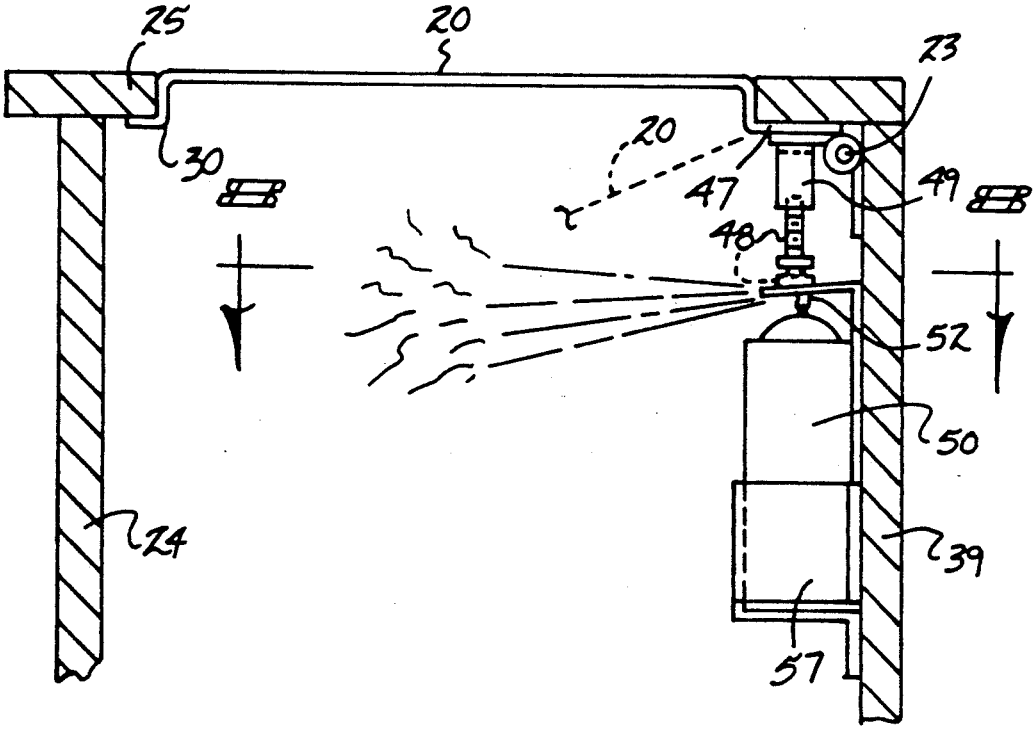

RECYCLING ORGANIZER APPARATUS

BACKGROUND OF THE INVENTION

1. Field of the Invention

The field of invention relates to recycling apparatus, and more particularly pertains to a new and improved recycling organizer apparatus wherein the same is arranged to accommodate and store for processing various materials.

2. Description of the Prior Art

Recycling apparatus of various types are utilized in the prior art to accommodate and categorize various components therewithin. Such apparatus is exemplified in U.S. Pat. No. 4,821,903 to Hayes setting forth a trash bin cart utilizing rows of aligned bins to accommodating various components therewithin.

U.S. Pat. No. 4,874,111 to Heller sets forth a multicompartment container accommodating various replaceable bag liners therewithin to receive various categories of recycling material.

U.S. Pat. No. 3,720,346 to Cypher sets forth a compartmented container utilizing displaceable partitions to accommodate various categories of recycling material.

U.S. Pat. No. 3,893,615 to Johnson sets forth a multicompartmented container setting forth rows of bag liners positioned in contiguous communication to overlying pivoted lids.

U.S. Pat. No. 4,801,034 to Sandomeno provides for a unitary housing including removable containers within a respective compartment within the housing.

As such, it may be appreciated that there continues to be a need for a new and improved recycling organizer apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of recycling apparatus now present in the prior art, the present invention provides a recycling organizer apparatus wherein the same provides for bag members mounted in a spaced relationship below pivoting doors to accommodate various categories of recycling material, as well as providing for processing equipment selectively positionable to a top surface of the organization. As such, the general purpose of the present invention, which will be described subsequently in greater detail, is to provide a new and improved recycling organizer apparatus which has all the advantages of the prior art recycling apparatus and none of the disadvantages.

To attain this, the present invention provides a housing including spaced side walls and a top wall, with a front wall thereof defining a plurality of pivotally mounted doors providing access interiorly of the housing. An upper door plate is pivotally mounted above the door and between a forward edge of the top walls and the doors to provide access to a top wall pivoting plate mounting a can crusher and can opener to permit processing of various cans and their deposit within one of a plurality of pivoting door plates mounted rearwardly and hingedly within a top wall. Underlying replaceable bag members are mounted to receive the processed cans and other recycled material. A modification of the invention includes an aerosol apparatus automatically actuated upon downward projection of a pivoting door of the rows of pivoting doors positioned above the bags.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved recycling organizer apparatus which may be easily and efficiently manufactured and marketed.

It is a further object of the present invention to provide a new and improved recycling organizer apparatus which is of a durable and reliable construction.

An even further object of the present invention is to provide a new and improved recycling organizer apparatus which is susceptible of a low cost of manufacture with regard to both materials and labor, and which accordingly is then susceptible of low prices of sale to the consuming public, thereby making such recycling organizer apparatus economically available to the buying public.

Still yet another object of the present invention is to provide a new and improved recycling organizer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic view, taken along the lines 2—2 of FIG. 1 in the direction indicated by the arrows.

FIG. 3 is an isometric fragmentary view of the invention illustrating the upper door plate in an opened configuration.

FIG. 4 is an isometric fragmentary view of the upper door plate in a second position mounting the top wall pivot plate to a second operative position from a first position, as illustrated in FIG. 3.

FIG. 5 is an orthographic view, taken along the lines 5—5 of FIG. 3 in the direction indicated by the arrows.

FIG. 6 is an orthographic view, taken along the lines 6—6 of FIG. 4 in the direction indicated by the arrows.

FIG. 7 is an orthographic cross-sectional illustration of a modified aerosol spray apparatus utilized in combination with the pivot doors utilized by the invention.

FIG. 8 is an orthographic top view of the aerosol apparatus in operative association with the pivot door plates, taken along the lines 8—8 of FIG. 7 in the direction indicated by the arrows.

FIG. 9 is an orthographic view, taken along the lines 9—9 of FIG. 1 in the direction indicated by the arrows.

DESCRIPTION OF THE PREFERRED EMBODIMENT

Figure 1:
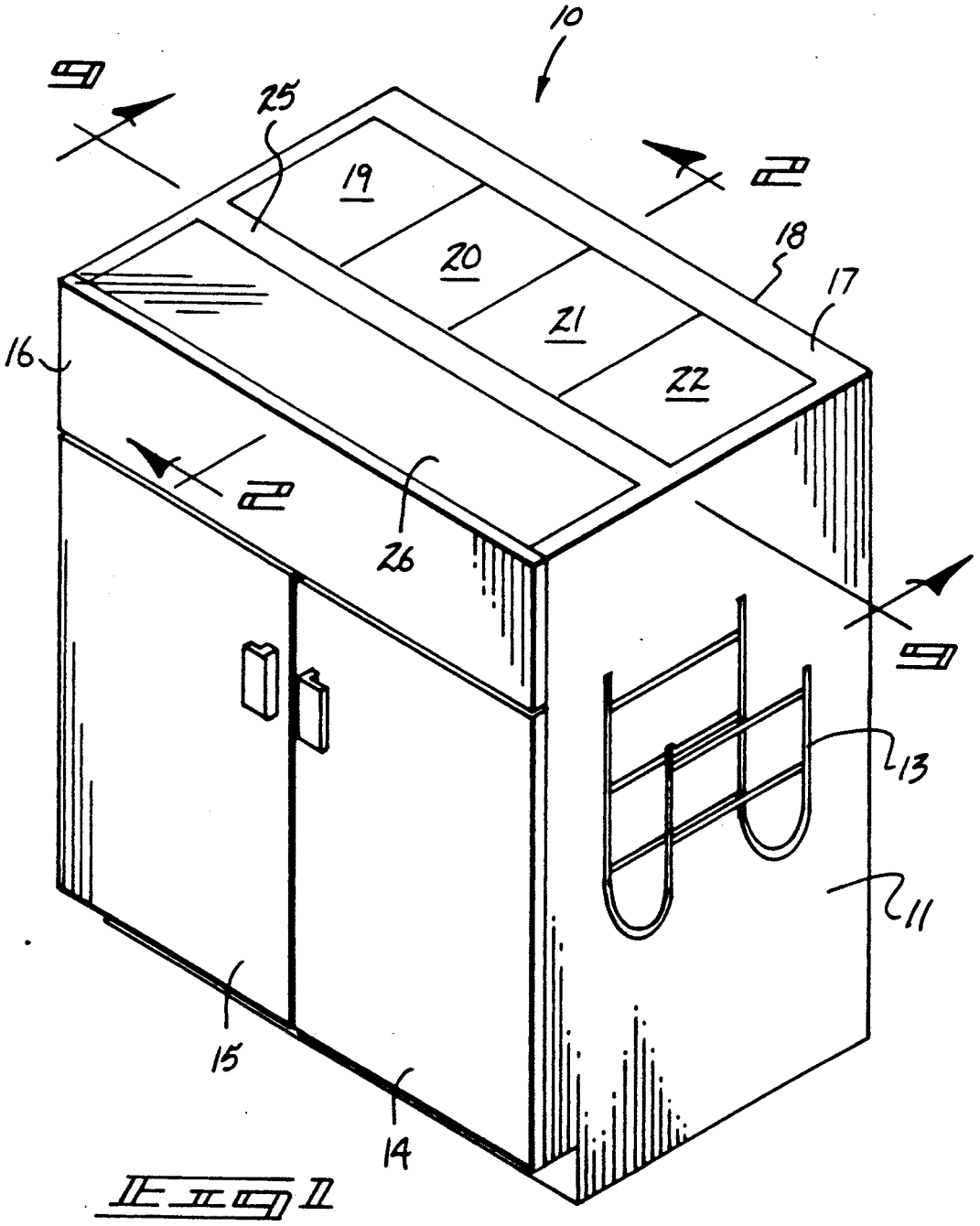
FIG. 1 is an isometric illustration of the instant invention.

With reference now to the drawings, and in particular to FIGS. 1 to 9 thereof, a new and improved recycling organizer apparatus embodying the principles and concepts of the present invention and generally designated by the reference numeral 10 will be described.

More specifically, the recycling organizer 10 of the instant invention essentially comprises a housing to include a right side wall 11 spaced from a left side wall 12. A "U" shaped storage bracket 13 is provided on the right side wall 11 for accommodating various papers to be recycled, such as newspapers and the like. The front wall includes a front wall right door 14 and a front wall left door 15 pivotally mounted to the respective right and left side walls 11 and 12 utilizing hinges, such as hinges 15*a*, as illustrated in FIG. 2.

An upper door plate 16 is formed within the front wall defined by a predetermined height to extend from an upper edge of the doors 14 and 15 to an associated top wall 17.

The top wall 17, including a rear edge 18, mounts a row of pivoted doors to include a respective first, second, third, and fourth pivoting door plate 19, 20, 21, and 22 respectively that are pivotally mounted adjacent the top wall rear edge 18 and spaced apart a predetermined equal spacing. A door plate spring hinge 23 hingedly biases the pivoting door plates 19–22 in coplanar alignment with the top wall 17 in a first position, as illustrated in FIG. 2 for example. An intermediate top wall plate 24 is spaced from and parallel a rear wall 39 of the housing and the front wall of the housing. The intermediate top wall plate 24 extends downwardly and orthogonally relative to a top wall central rib 25 and extends a predetermined height equal to the predetermined height of the upper door plate 16 and is oriented parallel to the upper door plate 16 when the upper door plate 16 is in a first position, as illustrated in FIG. 2. The top wall central rib 25 is spaced from the upper door plate 16 to accommodate a top wall pivot plate 26. The top wall pivot plate 26 extends substantially coextensively between the right and left side walls and is pivotally mounted about a pivot axle 27 orthogonally oriented between right and left side walls and parallel to the top wall central rib 25. An intermediate front wall plate 28 is parallel to the top wall 17 and integrally and orthogonally mounted to a lower terminal edge of the intermediate top wall plate 24 and extends forwardly to the front wall to include a front wall plate hinge 29 to hingedly mount a lower terminal edge of the upper door plate 16 relative to the intermediate front wall plate 28, as illustrated, to permit pivotment of the upper door plate 16 to a second horizontal orientation, as illustrated in FIG. 3 for example. An upper door plate flange 16*a* is integrally and orthogonally mounted to the upper door plate 16 spaced below a top edge of the upper door plate 16 a distance equal to a predetermined thickness defined by the top wall pivot plate 26 to provide a ledge for the top wall pivot plate 26, as illustrated in FIG. 2. A spring clip inclined leg 45 is mounted to the intermediate top wall plate 24 spaced below the top wall pivot plate 26 to include a leg abutment lip 46 mounted integrally to an upper end of the inclined leg 45 to provide an abutment surface for the top wall pivot plate 26. In this manner, the top wall pivot plate 26 may be rotated about the axle 27 when the upper door plate 16 is displaced from the first position, as illustrated in FIG. 2, permitting pivotment of the top wall pivot plate 26 to provide access and expose an associated can crusher 40 and a can opener 41 to operatively crush various cans and articles. The can crusher 40 includes an anvil 42, with a crush lever 43 mounting an upper plate 44 to crush cans between the upper plate 44 and the anvil 42. The electric can opener 40 may be electrically connected to a convenient electrical outlet supply 31 that may be mounted interiorly of the housing, as illustrated in FIG. 2 for example.

Each of the pivoting door plates 19–22 includes pivoting door "L" shaped flange 30 mounted at a forward edge thereof, wherein each "L" shaped flange extends below the top wall central rib 25 to engage a bottom surface of the top wall central rib 25 to maintain each of the pivoting door plates 19–22 in a coplanar relationship due to biasing of the door plate spring hinge 23 of each of the pivoting door plates 19–22 in the horizontal orientation relative to the top wall, as illustrated in FIG. 2, whereupon displacement of each door plate to direct various categories of recycled material downwardly permits deposit of such categories of material into underlying bag members 36 that are spaced below the pivoting door plates 19–22 a distance substantially equal to or greater than a predetermined length of each of the door plates to permit full pivotment of each of the door plates downwardly, if desired.

A plurality of parallel partition walls 33 are arranged parallel to the side walls and orthogonally relative to the top wall extending downwardly therefrom positioned intermediate the adjacent pivoting door plates 19–22. These provide chute constructions to direct various debris in alignment below each of the pivoting doors 19–22. A support rod 34 mounts spring clip pairs 35 to support the bag members 36 to accommodate the various categories of components directed through the pivoting door plates and slidably mounted along the support rod 34 to accommodate various configurations of bag members 36 contained and positioned upon the housing floor 37. A support clip 38 is provided and mounted to the interior surface of the rear wall 39 to assist in positioning the bags 36.

The invention, as illustrated in FIGS. 7 and 8, illustrates the use of an aerosol canister 50 mounted in alignment and below each door plate spring hinge 23 mounted to an associated pivoting door spring flange 47 of each pivoting door, such as pivoting door 20 as illustrated in FIG. 7. Telescoping actuator leg 48 is mounted telescopingly adjustably relative to a leg base 49 that in turn is mounted to the pivoting door spring flange 47. The actuator leg 48 is positioned adjacent an actuator nozzles 52 of each associated aerosol canister 50 that is in turn mounted within a support socket 51 positioned below each spring flange 47. In this manner, downward pivotment of the associated pivoting door 20 and each of the doors 19–22 effects actuation and discharge of an aerosol deodorizer or fumigant from each associated aerosol canister 50.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A recycling organizer apparatus, comprising, a housing, the housing including a right side wall spaced from and parallel a left side wall, a rear wall, a top wall, a floor, and a front wall defining the housing, the front wall including a respective right and left door pivotally mounted relative to the respective right and left side walls, and an upper, door plate pivotally mounted to the housing, with the upper door plate extending coextensively between the right side wall and left side wall orthogonally oriented relative to the right side wall and the left side wall, and a top wall pivot plate pivotally mounted to the top wall, with the top wall pivot plate including a pivot axle directed medially and longitudinally thereof, with the pivot axle oriented orthogonally relative to the right side wall and left side wall and parallel relative to the upper door plate permitting pivoting of the top wall pivot plate relative to the top wall, the top wall pivot plate including a top surface and a bottom surface, the bottom surface including can processing means mounted to the top wall pivot plate bottom surface for permitting the selective grinding and crushing of can members, and the upper door plate pivotally mounted from a first position coplanar with the front wall extending from the right door and the left door to the top wall, and the upper door plate pivotally displaceable to a second position orthogonally oriented relative to the front wall to permit pivoting of the top wall pivot plate relative to the top wall, and the top wall further includes a row of pivoting door plates, each pivoting door plate pivotally mounted relative to the top wall, with the top wall including a rear edge defined by an intersection of the rear wall and the top wall, and the row of pivoting door plates hingedly mounted relative to the top wall adjacent the top wall rear edge, and a plurality of bag members, wherein a bag member of said bag members is positioned below a respective pivoting door plate of said pivoting door plates.

2. An apparatus as set forth in claim 1 wherein the upper door plate includes an upper door plate flange fixedly and orthogonally mounted to the upper door plate spaced below a top edge of the upper door plate a predetermined spacing, and the top wall pivot plate defined by a predetermined thickness equal to the predetermined spacing, wherein the upper door plate flange provides an abutment for the top wall pivot plate when the upper door plate is in the first position.

3. An apparatus as set forth in claim 2 wherein the top wall includes a top wall central rib directed coextensively between and orthogonally oriented to the right side wall and the left side wall between the top wall pivot plate and the pivoting door plates, the top wall central rib includes an intermediate top wall plate extending fixedly and orthogonally below the top wall central rib defined by a predetermined height wherein the upper door plate is equal to a height equal to the predetermined height and the intermediate top wall plate is arranged parallel relative to the upper door plate when the upper door plate is in the first position, and intermediate front wall plate orthogonally mounted to a lower terminal edge of the intermediate top wall plate and extending forwardly to a junction defined by a lower terminal edge of the upper door plate and the right door and the left door, the intermediate front wall plate includes a front wall plate hinge to hingedly mount the upper door plate to the intermediate front wall plate, with the intermediate front wall plate spaced below the top wall pivot plate.

4. An apparatus as set forth in claim 3 wherein the intermediate top wall plate includes a spring clip inclined leg mounted to the intermediate top wall plate adjacent the top wall pivot plate, and the spring clip inclined leg includes a leg abutment lip mounted to an upper end of the spring clip inclined leg to define an abutment and engagement with the bottom surface of the top wall pivot plate.

5. An apparatus as set forth in claim 4 wherein each pivoting door plate includes an "L" shaped lip, wherein each "L" shaped lip extends into engagement with a bottom surface of the top wall central rib when each pivoting door plate is in a first horizontal coplanar orientation relative to the top wall, and each pivoting door plate including a door plate spring hinge, with the door plate spring hinge mounted to the top wall and the rear wall to bias each pivoting door plate to the horizontal first position.

6. An apparatus as set forth in claim 5 including a support rod positioned below the intermediate top wall plate, with the support rod including plural pairs of spring clips, wherein each pair of the plural pairs of spring clips mounts a bag member of said bag members to position one of said bag members below a respective pivoting door plate.

7. An apparatus as set forth in claim 5 wherein the can processing means includes a can opener and a can crusher, the can crusher including an anvil fixedly mounted to the top wall pivot plate, and the anvil mounting an upper plate reciprocatably relative to the anvil, the upper plate including a crush lever mounted to the upper plate to effect reciprocation of the upper plate relative to the anvil.

* * * * *